United States Patent [19]

Pan et al.

[11] 4,112,285

[45] Sep. 5, 1978

[54] INDUCTION HEATING USING PARALLEL ELECTRIC/MAGNETIC FIELDS

[75] Inventors: Peter N. Y. Pan, Country Club Hills; Steve F. Wronski, Chicago, both of Ill.

[73] Assignee: The Continental Group, Inc., New York, N.Y.

[21] Appl. No.: 776,840

[22] Filed: Mar. 14, 1977

[51] Int. Cl.[2] ..... H05B 5/06

[52] U.S. Cl. ..... 219/10.41; 118/639; 219/10.65; 219/10.79; 219/10.81; 427/22; 427/375; 355/3 DD

[58] Field of Search ..... 219/10.57, 10.41, 10.81, 219/10.53, 6.5, 9.5, 10.65, 10.69, 10.61, 10.79, 76, 149; 427/12, 13, 22, 27, 195, 375; 118/620, 623, 638, 639; 355/3 DD

[56] References Cited

U.S. PATENT DOCUMENTS

| | | | |
|---|---|---|---|
| 3,840,138 | 10/1974 | Mohr | 219/9.5 |
| 3,869,300 | 3/1975 | Scheiber | 427/195 |
| 3,965,321 | 6/1976 | Brinkmann et al. | 219/10.57 |
| 4,033,292 | 7/1977 | Klingenberg | 427/21 |

*Primary Examiner*—Bruce A. Reynolds

*Attorney, Agent, or Firm*—Diller, Brown, Ramik & Wight

[57] ABSTRACT

An induction heater system for fusing substrates having charged powder particles deposited thereon, the system comprising a conveyor means for conveying the substrates along a predetermined path and a fusing means disposed along and adjacent to the predetermined path for fusing the substrates. There is provided a means for creating an electric field in a given direction so as to provide a counter force in a direction opposite to the direction of tear-away forces acting on the particles, the latter being created by the electromagnetic influence of the fusing means on the particles.

33 Claims, 6 Drawing Figures

INDUCTION HEATING USING PARALLEL ELECTRIC/MAGNETIC FIELDS

Figure 1:
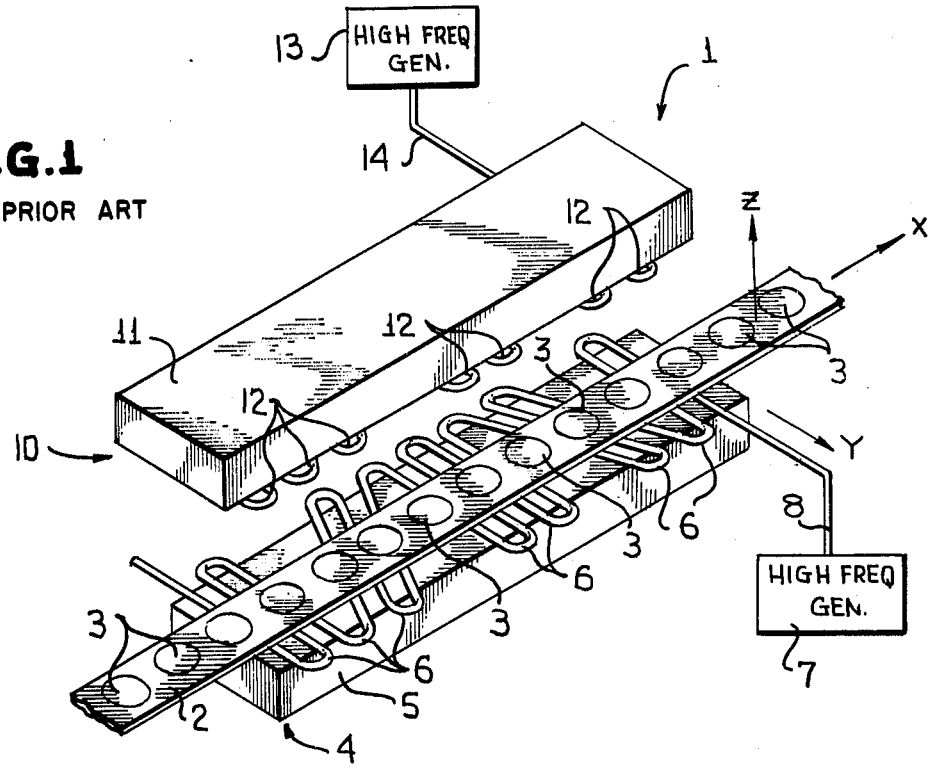
FIG. 1 PRIOR ART

The invention generally relates to an induction heater system for fusing substrates having charged powder particles deposited thereon, and more specifically to a method and arrangement for implementing a short cure (fusing) technique for treating coated substrates having previously deposited charged powder particles adhering thereto.

The powder coating of metallic and other objects (such as, for example, but not limited to, can end units) using a pulsed powder application system has been described elsewhere. For example, see co-pending application Ser. No. 678,676, now U.S. Pat. No. 4,027,607 wherein there is described a double fluidized bed pulsed electrostatic powder application system which may be used to deposit charged powder particles onto substrates, such as container end units, so as to eliminate inherent metal exposure to products subsequently packaged therein.

In the employment of such powder coating systems, it has become necessary to develop short cure (fusing) techniques for treating substrates virtually immediately after being coated with electrostatic charged powder. In this regard, there has been developed an induction heater system of the transverse flux type, through which recently electrostatically coated substrates are conveyed for the purpose of fusing. Such a system generally employs a coil system or systems, each coil system being connected to a high frequency generator which applies a high frequency signal thereto with the resultant generation of heat which accomplishes the fusing process.

However, employment of the induction heater systems, such as generally described above, lead to problems in that, when fusing substrates, such as end units of either steel or aluminum having a charged powder coating thereon, such induction heater systems of the transverse or other type act on the powder particles in such a way as to cause them to have a tendency to be redistributed on the substrate, or away from the substrate, upon entering the induction heater system prior to polymer melt (that is to say, prior to irreversibility of the fusing process).

Therefore, in order to minimize the powder relocation problem described immediately above, there is provided a means for imposing an external electric field of such force and orientation as to produce a counterforce, that is to say, a force acting in a direction opposite to the relocation forces acting on the charged powder particles.

Therefore, it is an object of the present invention to provide an induction heater system for fusing substrates having charged powder particles recently deposited thereon.

It is a further object of the present invention to provide an induction heater system wherein the charged powder particles contained on recently coated substrates are not affected by relocation forces inherent in the induction heater system.

It is a further object of the present invention to provide an induction heater system which includes a means for imposing, on the charged powder particles, counterforces having a magnitude and direction such as to oppose the aforementioned relocation forces.

Figure 2A:
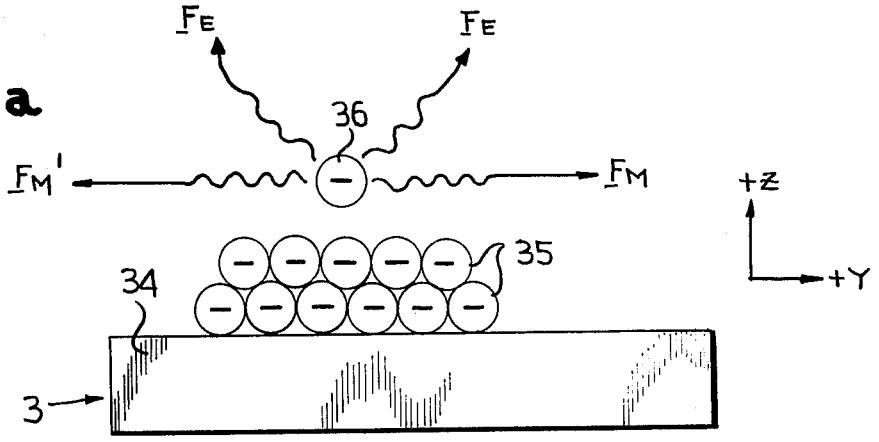
Figure 2B:
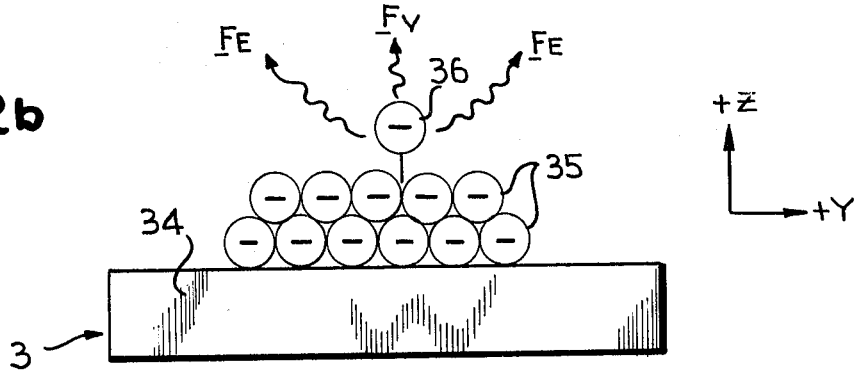
Figure 3:
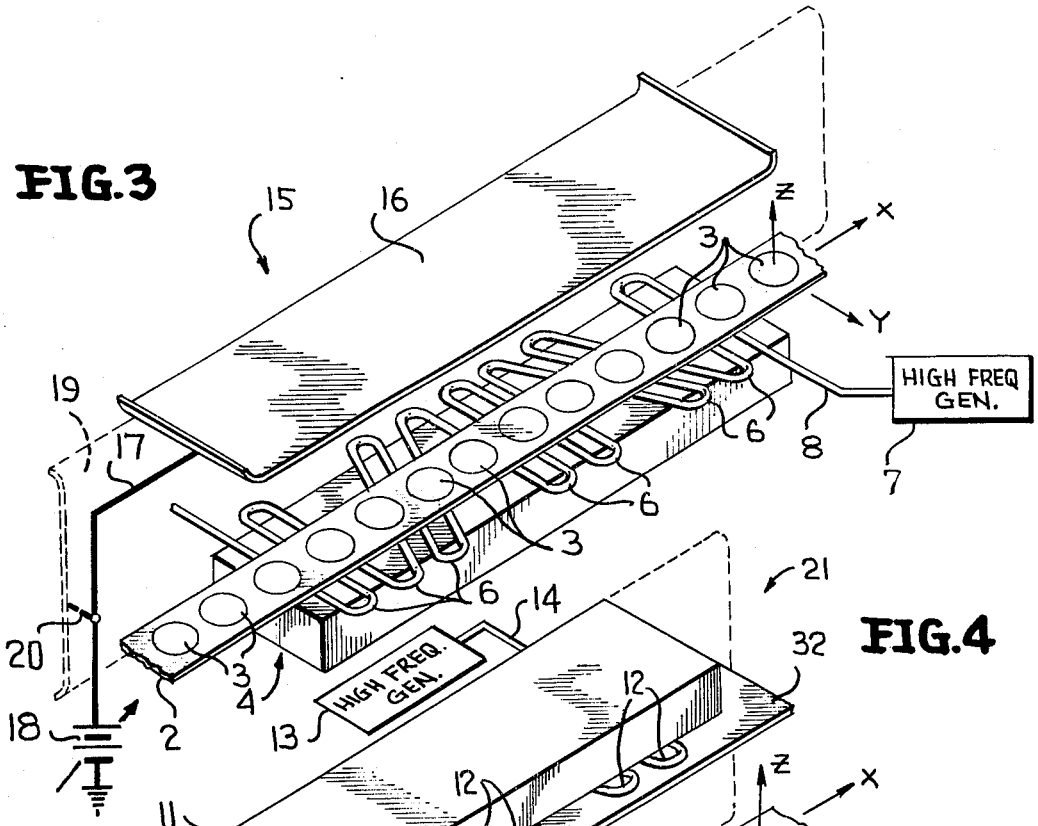
Figure 4:
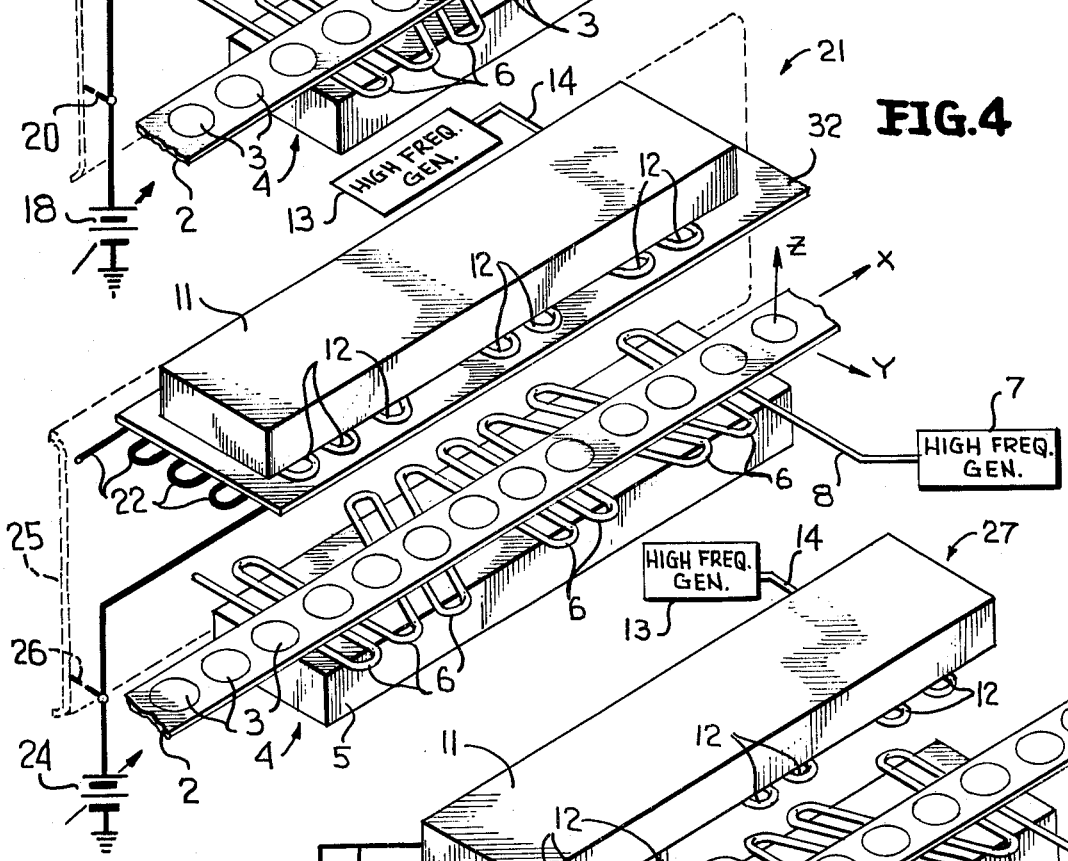
Figure 5:
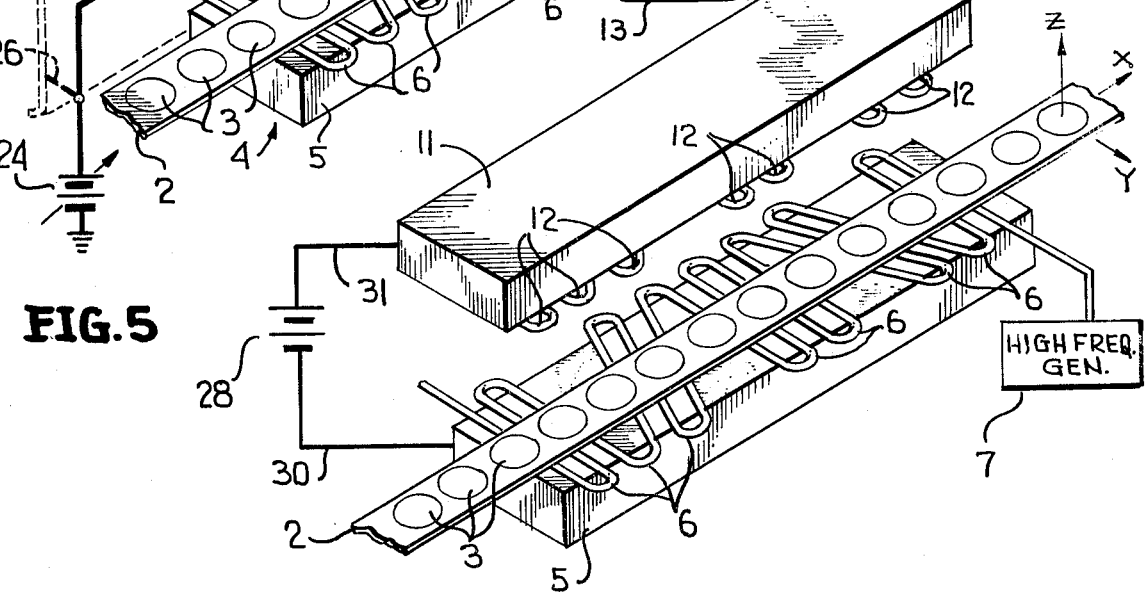

With the above and other objects in view that will hereinafter appear, the nature of the invention will be more clearly understood by reference to the following detailed description, the appended claimed subject matter, and the accompanying drawings, of which:

FIG. 1 is a diagrammatic representation of a transverse flux induction heater system;

FIGS. 2*a* and 2*b* are diagrammatic representations of a substrate recently coated with electrostatic charged powder particles;

FIG. 3 is a diagrammatic representation of a transverse flux induction heater system of the single induction heater type; and FIGS. 4 and 5 are diagrammatic representations of transverse flux induction heater systems of the double induction heater type.

The short cure, or fusing, technique for treating substrates recently coated with charged powder particles, as well as the relocation force problem previously mentioned, will be more clearly understood by reference to FIG. 1, which shows a transverse flux induction heater system of the double induction heater type. As shown in FIG. 1, the induction heater system 1 includes a conveyor belt 2 for conveying recently coated substrates 3 along a path in the direction indicated by the arrow X. In order to accomplish fusing, there is provided, at the minimum, an induction heater which is generally indicated by the reference numeral 4 and which further includes ferrite or iron laminations 5 on which is mounted a coil arrangement 6. The coil arrangement 6 is, in turn, connected to the high frequency generator 7 via the lead wire 8. The high frequency generator 7 provides a high frequency signal via the lead wire 8 to the coil arrangement 6 so as to generate the heat necessary to accomplish fusing or curing of the recently coated substrates 3. As thus far described, the induction heater system is of the single induction heater type such as is generally employed for the induction heater fusing of steel end units.

In addition to the above-mentioned components, the transverse flux induction heater system further includes an induction heater, generally indicated by the reference numeral 10, which comprises ferrite or iron laminations 11 on which is mounted a coil arrangement 12. The induction heater 10 is positioned, as shown in FIG. 1, on that side of the conveyor 2 opposite to the side on which is positioned the induction heater 4. Furthermore, the coil arrangement 12 is connected to a high frequency generator 13 via the lead wire 14 for the purpose of providing a high frequency signal to the coil arrangement 12 so as to effect fusing or curing of the recently coated substrates 3. As thus described, the induction heater system 1 is of the double induction heater type such as is usually employed for the curing or fusing of aluminum end units.

When an inducation heater system 1 (of either the single or double induction heater type) is employed for the purpose of curing or fusing substrates 3 of either steel or aluminum having a charged powder coating on the surface thereof, the powder particles have a tendency to be redistributed on or away from the substrates 3 as the latter is carried by the conveyor 2 past the induction heaters 4 and 10. This redistribution of powder particles results from two phenomena as will now be described with reference to FIGS. 1, 2*a* and 2*b*.

Assuming for purposes of explanation that the induction heaters 4 and 10 are of the transverse flux type design, as shown in FIG. 1, the application of high frequency signals by high frequency generators 7 and 13 to coil arrangements 6 and 12, respectively, will cause magnetic field forces to be established in the Z direction. As indicated previously, the substrates 3, which have been recently powder coated, are conveyed by the conveyor 2 in the direction indicated by the arrow X. Under well known electromagnetic principles, this will give rise to a Lorentz force which has a direction transverse to the path of the substrates 3 and in the direction indicated by the arrow Y.

The coil arrangements 6 and 12 each have an angular design. The high frequency signals of the high frequency generators 7 and 13 are passed through their respective coil arrangements 6 and 12, each establishing magnetic field forces in the Z direction. The magnetic field forces are subjected to the angularity of the coil arrangements 6 and 12, thereby the magnetic field forces are rotated in the X–Y plane. The rotation of the magnetic field forces simulates rotation of the substrates 3, as they move over the coil arrangements 6 and 12. The simulated rotation will cause a temperature uniformity of ± 10° F. to be substantially maintained across the substrates 3.

As indicated by the diagrammatic representation of FIG. *2a*, the substrate 3 has on its surface 34 newly deposited electrostatic charged particles such as those indicated by the reference numeral 35. It is to be noted that the diagrammatic representation of FIG. *2a* assumes that the viewer is observing the approach of respective substrates 3 from a point downstream in the path indicated previously by the arrow X. Thus, the previously mentioned Lorentz or electromagnetic force will be as indicated by the arrows $F_M$ or $F_M'$ in FIG. *2a*. This force, which will be subsequently called a tear-away force, will act on certain charged particles such as particle 36 so as to tear them away from the substrate 3. This will be especially true prior to "melt and flow," that is to say, prior to the onset of the curing or fusing process, when the particles 35 are held to the surface 34 only by image forces and Van Der Waals forces which are substantially less in magnitude than the tear-away forces.

Once the particle 36 is dislodged, and moved away, from the surface 34 and the other adhering particles 35, a further repelling force is experienced. This is due to the fact that, when the particle 36 is dislodged, Gauss's Law (which dictates that any collection of charged particles creates a net surface potential from a hypothetical surface surrounding those particles) takes over, and a self-generated electric field force $F_E$ pushes the particles 36 further away from the surface 34 in the plus Z direction. The separated particle 36, because it is charged, immediately hunts a ground or higher potential to which to attach itself.

Thus, in summary, the movement of the substrates 3 through the magnetic field created by the induction heaters 4 and 10 causes the primary generation of a Lorentz force $F_M$ (or $F_M'$) (i.e., a tear-away force), and the secondary generation of a further repulsion force, $F_E$.

Further phenomena, and resultant tear-away forces, result from the use, with the induction heaters 4 and 10, of high frequency generators 7 and 13. With reference to FIGS. 1 and *2b*, the generators 7 and 13 operate at a very high frequency (for example, 10kHz). Due to this fact, and also due to the poor mechanical coupling of the substrate 3 to the conveyor 2, the substrate 3 will experience a vibrational force which, for the arrangement as shown in FIG. 1, acts in the plus Z or minus Z direction. This vibrational force indicated by the designation $F_V$ in FIG. *2b*, will act on particles such as 35 so as to cause them to become dislodged from the surface 34 of the substrate 3. As a result, particles such as 36 will be separated from the particles 35 and, once dislodged, the particles 36 will be acted upon by the previously described self-generated electric field force $F_E$ acting generally in the plus Z direction. As also previously described, the separated particle 36 will hunt ground or higher potential, seeking a surface to which to attach itself.

The invention will now be further described with respect to FIG. 3 which shows a transverse flux induction heater arrangement 15 of the single induction heater type. Where possible, like reference numerals will be retained for like elements. As previously described, as the substrates 3 are moved by the conveyor 2 past the induction heater 4 (which includes ferrite or iron laminations 5 on which is mounted a coil arrangement 6), Lorentz forces $F_M$ are experienced in the plus Y or minus Y directions, and additionally both electric field forces $F_E$ and vibrational forces $F_V$ are experienced, both generally in the plus Z direction. Thus, in the example given, charged powder particles are dislodged from the substrates 3 and tend to move to a direction away from the induction heater 4, seeking a point of ground or higher potential. To minimize this powder relocation, it is necessary to provide or increase the force holding the particles 35 (see FIGS. *2a* and *2b*) to the surface 34 of the substrate 3. This is accomplished by imposing an external E-field on the particles 35. Thus, a flat plane electrode 16 is disposed on that side of the conveyor 2 opposite to the side on which is disposed the induction heater 4, the flat plane electrode 16 being connected via the lead 17 to a DC source 18 of high voltage. This will cause the imposition of an electric field force acting in the minus Z direction on the particles 35 (see FIGS. *2a* and *2b*), preventing them from becoming dislodged from the surface 34 of the substrate 3. Thus, the provision of the flat plane electrode 16 and associated source 18 create a counter-force acting to oppose the previously mentioned forces $F_E$ and $F_V$ (see FIGS. *2a* and *2b*).

However, thus far, no provision has been made to counter the Lorentz forces themselves ($F_M$ or $F_M'$ of FIG. *2a*). Considering the case of Lorentz force $F_M$ directed in the minus Y direction, provision for opposing such force can be provided by disposing a flat plane electrode 19, as shown in FIG. 3, and by connecting the electrode 19 via a lead 20 to the previously mentioned high voltage DC source 18.

With respect to FIG. 4, the transverse flux induction heater arrangement 21 of the double induction heater type will now be considered, like reference numerals being retained for like elements where possible. As previously described, newly coated substrates 3 may be conveyed by the conveyor 2 between induction heaters 4 and 10 which comprise coil arrangement 6 mounted on ferrite or iron laminations 5, and coil arrangement 12 mounted on ferrite or iron laminations 11, respectively. High frequency generators 7 and 13 are connected, respectively, to coil arrangements 6 and 12 so as to apply high frequency signals thereto.

As thus described, substrates 3 moving between induction heaters and and 10 on the conveyor 2 will experience and be acted upon by the forces $F_M$, $F_E$ and $F_V$, as previously described with respect to FIGS. *2a* and 2b. In order to counter-balance such forces, the arrangement 21 is provided with a fine wire arrangement 22 connected via a lead 23 to a high voltage DC source 24. As thus connected, the fine-wire arrangement 22 will provide a fine-wire electric field force acting in the minus Z direction so as to counter-balance the forces $F_E$ and $F_V$.

Additionally, with reference to FIGS. 2a and 4, the Lorentz force $F_M$ may be counter-balanced by the provision within arrangement 21 of the flat plane electrode 25 connected, via the lead 26, to the high voltage source 24.

An alternative method, or an additional method, of counter-balancing the forces $F_E$ and $F_V$ in a double induction heater arrangement is shown in FIG. 5. The double induction heater arrangement 27 again includes a conveyor 2 for conveying newly coated substrates 3 between induction heaters 4 and 10, induction heaters 4 and 10 including ferrite or iron laminations 5 for mounting the coil arrangement 6, and ferrite or iron laminations 11 for mounting the coil arrangement 12, respectively. High frequency generating sources 7 and 13 are connected to the coil arrangements 6 and 12, respectively, for imparting a high frequency signal thereto so as to cause fusing or curing of the substrates 3 as they pass between the induction heaters 4 and 10. For the purpose of counter-balancing the forces $F_E$ and $F_V$ (see FIGS. 2a and 2b) which act in the plus Z (or minus Z) direction, the arrangement 27 includes a high voltage DC source 28 connected, via leads 30 and 31, to the ferrite or iron laminations 5 and 11, respectively. Thus, the source 28 places a high voltage across the ferrite or iron laminations 5 and 11 so as to create therebetween an electric field which acts in a direction opposite to the forces $F_E$ and $F_V$, that is to say, in the minus Z (or plus Z) direction.

It should be further noted, with respect to FIG. 5, that the coil arrangements 6 and 12 may be insulated (as indicated by the dark shading of the coil arrangements 6 and 12 in FIG. 5), thus providing a shielding of the coils 6 and 12 from the low reluctance laminations 5 and 11 while the aforementioned voltage bias is applied to the laminations 5 and 11 by the source 28.

Having thus described the various arrangements according to the invention, it is to be noted that further variations of the concept of providing counter-balancing forces are available. For example, in order to counter-balance either the Lorentz forces, $F_M$ or $F_M'$, and the vibrational forces $F_V$, it is possible to increase the frequency of the high frequency generators 7 and 13 so as to make the mass inertia of the particles 35 (see FIGS. 2a and 2b) relatively more substantial, that is to say, more substantial relative to the applied forces and the frequency of application. Thus, under this possibility, the mass inertia of the particles 35 will be such as to make it impossible or unlikely that the particles 35 will respond, to any substantial degree, to the field or vibrational forces.

With reference to FIGS. 3 and 4, it is to be noted that, whereas those figures disclose high voltage DC sources 18 and 24 respectively connected to flat plane electrodes 19 and 25, the high voltage sources 18 and 24 could be replaced by such sources as would provide a time varying electric field which varies at the magnetic field frequency, that is to say, at the frequency of the high frequency generators 7 and 13, and in the plus Y (or minus Y) direction. In the above case, if both amplitude and phase matching were provided between the high frequency generators 7 and 13, on the one hand, and the time varying sources 18 and 24, the Lorentz forces $F_M$ (or $F_M'$) could be cancelled or counter-balanced.

With respect to FIG. 4, it is to be noted that an insulator 32 may be provided between the ferrite or iron laminations 11 and the fine-wire arrangement 22, the insulator 32 also being usable as a mounting or support for the arrangement 22.

While preferred forms and arrangements have been shown in illustrating the invention, it is to be clearly understood that various changes in details and arrangement may be made without departing from the spirit and scope of this disclosure.

We claim:

1. An induction heater system for fusing substrates having charged powder particles deposited thereon, said system comprising, in combination:

conveyor means for conveying said substrates along a predetermined path;

fusing means disposed along and adjacent to said predetermined path for fusing said substrates, said fusing means acting on said particles so as to impose thereon tear-away forces acting in a direction away from said predetermined path; and electric field creating means adjacent to said predetermined path for imposing an electric field force on said powder particles in a direction opposite to the direction of said tear-away forces.

2. A system as recited in claim 1 wherein said electric field creating means includes DC voltage means for providing DC voltage, and electrode means connected to said DC voltage means and disposed adjacent to said predetermined path for receiving said DC voltage and responsive thereto for imposing said electric field force on said particles.

3. A system as recited in claim 2 wherein said DC voltage means provides a high DC voltage.

4. A system as recited in claim 2 wherein said predetermined path is a planar path and said tear-away forces act perpendicularly to said planar path, said electrode means being a flat planar electrode disposed parallel and adjacent to said planar path.

5. A system as recited in claim 2 wherein said predetermined path is a planar path and said tear-away forces act transverse and parallel to said planar path, said electrode means being a flat planar electrode disposed perpendicular and adjacent to said planar path.

6. A system as recited in claim 2 wherein said fusing means includes a single induction heater coil.

7. A system as recited in claim 6 wherein said predetermined path is a planar path and said single induction heater coil is disposed on one side of and parallel to said planar path, said tear-away forces being electromagnetic forces transversely parallel to said planar path and imposed on said charged particles by said single induction heater coil, said electrode means being a flat planar electrode disposed perpendicular and adjacent to said planar path.

8. A system as recited in claim 6 wherein said fusing means also includes a high frequency generator means connected to said single induction heater coil for applying a high frequency signal thereto, said high frequency signal acting on said particles to vibrate them so as to effect tear-away forces perpendicular to and away from said planar path, said electrode means being a flat planar electrode disposed parallel to and on that side of said planar path remote from said induction heater coil.

9. A system as recited in claim 6 wherein said single induction heater coil has an angular design for simulating rotation of said substrates as said substrates move through said system wherein the simulated rotation causes a temperature uniformity of ± 10° F. to be substantially maintained across said substrate.

10. A system as recited in claim 1 wherein said electric field creating means includes DC voltage means for providing a DC voltage, and electric wire means connected to said DC voltage means and disposed adjacent to said predetermined path for receiving said DC voltage and responsive thereto for imposing said electric field force on said particles.

11. A system as recited in claim 10 wherein said DC voltage means provides a high DC voltage.

12. A system as recited in claim 10 wherein said predetermined path is a planar path and said tear-away forces act perpendicularly to said planar path, said electric wire means being disposed in a plane parallel and adjacent to said planar path.

13. A system as recited in claim 10 wherein said predetermined path is a planar path and said tear-away forces act transverse and parallel to said planar path, said electric field creating means including a flat plane electrode disposed perpendicularly and adjacent to said planar path and connected to said DC voltage means.

14. A system as recited in claim 10 wherein said predetermined path is a planar path and said fusing means includes a first induction heater coil on one side of and parallel to said planar path and a second induction heater coil on the other side of and parallel to said planar path.

15. A system as recited in claim 14 wherein said tear-away forces act perpendicularly to said planar path, said electric wire means being disposed in a plane parallel and adjacent to said planar path.

16. A system as recited in claim 15 wherein said electric wire means is disposed between said planar path and one of said induction heater coils, and including insulation means between said electric wire means and said one of said induction heater coils.

17. A system as recited in claim 15 wherein said tear-away forces act transverse and parallel to said planar path, said electric field creating means including a flat plane electrode disposed perpendicularly and adjacent to said planar path and connected to said DC voltage means.

18. A system as recited in claim 15 wherein said fusing means also includes high frequency generator means connected to said first and second induction heater coils for applying a high frequency signal thereto.

19. A system as recited in claim 18 wherein said high frequency generator means applies signals of such high frequency so as to preclude tear-away forces due to vibration.

20. A system as recited in claim 14 wherein said first and second induction heater coils each has an angular design for simulating rotation of said substrates as said substrates move through said system wherein the simulated rotation causes a temperature uniformity of ± 10° F. to be substantially maintained across said substrate.

21. A system as recited in claim 1 wherein said predetermined path is a planar path and said fusing means includes a first induction heater coil on one side of and parallel to said planar path and a second induction heater coil on the other side of and parallel to said planar path and wherein said fusing means includes first and second lamination means connected to said first and second induction heater coils, respectively, remote from said planar path for mounting said respective induction heater coils.

22. A system as recited in claim 21 wherein said lamination means are electroconductive, said electric field creating means including DC voltage means connected to said first and second lamination means for applying a high voltage thereto so as to create said electric field force.

23. A system as recited in claim 22 wherein said fusing means includes insulation means carried on and electrically insulating said first and second induction heater coils.

24. A system as recited in claim 21 wherein said first and second induction heater coils each has an angular design for simulating rotation of said substrates as said substrates move through said system wherein the simulated rotation causes a temperature uniformity of ± 10° F. to be substantially maintained across said substrate.

25. A system as recited in claim 1 wherein said substrates are can end units.

26. A method of counteracting tear-away forces while fusing substrates having charged powder particles deposited thereon, comprising the steps of:

(a) conveying said substrates along a predetermined path;

(b) providing at least one induction heater coil adjacent to said predetermined path;

(c) applying high frequency current to said at least one induction heater coil so as to fuse said substrates, while imposing on said powder particles a tear-away force in a direction away from said predetermined path; and (d) applying a DC electric field to said substrates so as to impose a counter-force on said powder particles in a direction toward said predetermined path, whereby to counteract said tear-away force.

27. A method as recited in claim 26 wherein step (d) comprises providing an electrode adjacent to said predetermined path and remote from said at least one induction heater coil, and applying a high voltage to said electrode so as to create said DC electric field.

28. A method as recited in claim 26 wherein said step (d) comprises providing an electric wire adjacent to said predetermined path, and applying a high voltage to said electric wire so as to create said DC electric field.

29. A method as recited in claim 28 wherein step (d) includes providing an insulator between and joining said electric wire and one of said at least one induction heater coils.

30. A method as recited in claim 26 wherein a plurality of induction heater coils is provided adjacent said path and step (b) includes providing one lamination for each of said induction heater coils, and connecting each lamination to a respective one of said induction heat coils.

31. A method as recited in claim 30 wherein step (d) comprises applying a voltage to each of said laminations provided during step (b) so as to create said DC electric field.

32. A method as recited in claim 26 wherein said substrates conveyed during step (a) are can end units.

33. A method as recited in claim 26 wherein said induction heater coil of step (b) has an angular design, the high frequency current of step (d) is subjected to the angularity of said induction heater coil whereby the high frequency current is rotated in a plane parallel to said induction heater coil, and the rotation of the high frequency current simulates rotation of said substrates as said substrates move over said induction heater coil whereby the simulated rotation causes a temperature uniformity of ± 10° F. to be substantially maintained across said substrate.

* * * * *